US005362224A

United States Patent [19]

Hasti et al.

[11] Patent Number: 5,362,224

[45] Date of Patent: Nov. 8, 1994

[54] CHIMNEY LINING FORMER AND COMPACTOR

[75] Inventors: George A. Hasti, Eden Prairie; Gerard D. Dykhoff, Hopkins, both of Minn.

[73] Assignee: Worldwide Chimney, Inc., Eden Prairie, Minn.

[21] Appl. No.: 146,593

[22] Filed: Nov. 1, 1993

[51] Int. Cl.[5] ..... B05C 7/06; B28B 7/28

[52] U.S. Cl. ..... 425/457; 118/105; 425/262; 425/460

[58] Field of Search ..... 425/193, 262, 427, 456, 425/457, 460; 118/105, DIG. 10

[56] References Cited

U.S. PATENT DOCUMENTS

| | | | |
|---|---|---|---|
| Re. 21,164 | 7/1939 | Tate | 425/460 |
| 3,990,830 | 11/1976 | Slade | 425/262 |
| 4,252,763 | 2/1981 | Padgett | 425/460 |
| 4,256,445 | 3/1981 | Pingree | 425/262 |
| 4,728,280 | 3/1988 | Wosje | 425/460 |

*Primary Examiner*—James Mackey

*Attorney, Agent, or Firm*—Palmatier, Sjoquist & Helget

[57] ABSTRACT

The invention relates to a chimney lining device which includes a shell member which telescopically embraces the exterior of a bell member. A shell member of desired dimensions may be used in conjunction with a standard sized bell member for the lining of various sized chimneys. Both the bell member and the selected shell member are formed of one-piece construction enhancing the durability and performance of the chimney lining device. During use, the invention is generally lowered to the bottom of a chimney whereon a masonry mortar compound is deposited within the chimney covering the chimney lining device. The chimney lining device is then activated causing the vibration of the bell member and the shell member. The chimney lining device is then slowly raised within the chimney, which causes a uniform and compacted thickness of masonry mortar compound to be deposited to the interior walls of the chimney.

15 Claims, 2 Drawing Sheets

CHIMNEY LINING FORMER AND COMPACTOR

BACKGROUND OF THE INVENTION

During the construction of buildings, chimneys have been erected having flues of varying internal dimensions. Frequently, due to the material selected for the chimney, the age of the chimney, and/or the exposure of the chimney to adverse weather or use conditions, a necessity arises for the lining of a chimney with a masonry mortar compound. In the past, the chimney lining devices used during the application of masonry mortar compounds have not been adjustable in size for use with varying sized chimneys. Chimney lining devices as known generally were enlarged by the inclusion of expansion slats. The incorporation of expansion slats into a chimney lining device is a time consuming process. In addition, the inclusion of expandable members or slats significantly reduced the structural integrity of the device, especially when exposed to the vibrational forces required for compaction of a masonry mortar compound to the interior walls of the chimney. As such, an expandable chimney lining device frequently fractured, bent or failed following prolonged use. In the past, the cleaning and removal of expansion members or slats from a chimney lining device was difficult and time consuming. The present invention eliminates these described problems while simultaneously enhancing the structural strength, durability, and useful life of a chimney lining device.

SUMMARY OF THE INVENTION

The invention relates to a chimney lining device which includes a shell member which telescopically embraces the exterior of a bell member. A shell member of desired dimensions may be used in conjunction with a standard sized bell member for the lining of various sized chimneys. Both the bell member and the selected shell member are formed of one-piece construction enhancing the durability and performance of the chimney lining device. During use, the invention is generally lowered to the bottom of a chimney whereon a masonry mortar compound is deposited within the chimney covering the chimney lining device. The chimney lining device is then activated causing the vibration of the bell member and the shell member. The chimney lining device is then slowly raised within the chimney, which causes a uniform and compacted thickness of masonry mortar compound to be deposited to the interior walls of the chimney.

It is an object of the present invention to provide a new and improved chimney lining device of relatively simple and inexpensive design, construction and operation, which is safe and durable, and which fulfills the intended purpose of lining a chimney without fear of injury to persons and/or damage to property.

It is another object of the present invention to provide a chimney lining device which incorporates the use of a standard sized bell member, and selection of a shell member of varying size for telescopically embracing the bell member during the lining of a chimney.

It is still another object of the present invention to provide a chimney lining device where the replacement of one sized shell member for another is quick and efficient, enhancing the utility of the device to an individual.

It is still another object of the present invention to provide a chimney lining device where the bell and shell members are integrally connected such that the vibrational movement of the bell member simultaneously vibrates the shell member for the compaction of a masonry mortar compound.

It is still another object of the present invention to provide a chimney lining device which is versatile with respect to use within different sized chimneys which simultaneously affords enhanced structural properties.

A feature of the present invention includes a standard sized bell member having a nose portion, a box-shaped lower portion, a vibrator, a light, and fastener seats for engagement to the shell member.

Another feature of the present invention includes a shell member of larger size than the bell member, where the shell member includes a nose engagement section having a bell engagement opening for telescopically embracing the nose portion of the bell member.

Still another feature of the present invention includes a shell member further having a box-shaped bell engagement section and lateral fastening means for engagement to the fastening seats, which securely attaches the shell member to the exterior of the bell member.

Still another feature of the present invention includes the selection of a shell member for engagement to a bell member, which satisfies the particular dimensional requirements for compacting a masonry mortar compound during the lining of a chimney.

Still another feature of the present invention includes a cable opening traversing the nose portion of the bell member, which provides a means for the raising or lowering of the invention during the lining of a chimney.

Still another feature of the present invention includes a power cable and control means for operational control of either the vibrator or the light during the lining of a chimney.

DETAILED SPECIFICATION OF THE PREFERRED EMBODIMENT

Figure 1:
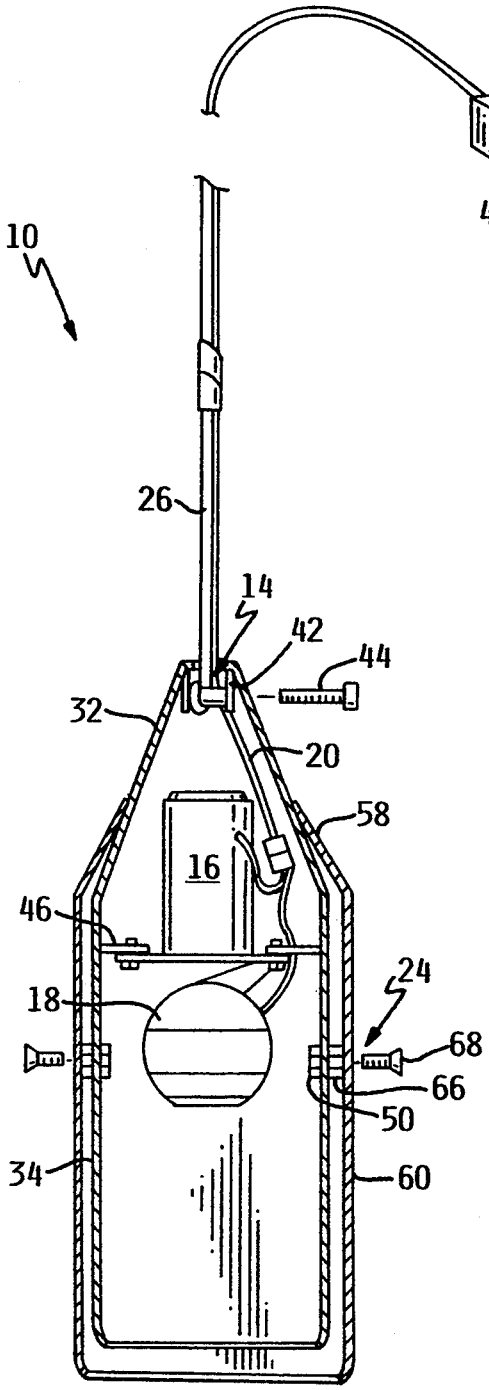
FIG. 1 is a cross-sectional side view of the invention.
Figure 2:
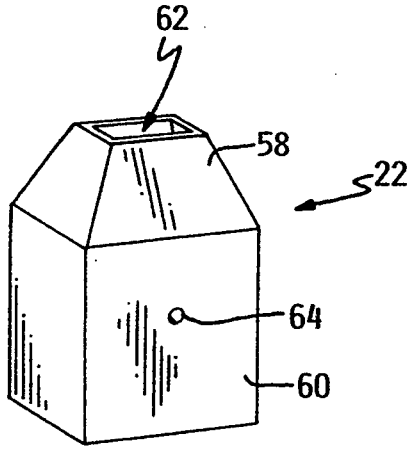
FIG. 2 is a isometric view of the shell member.
Figure 3:
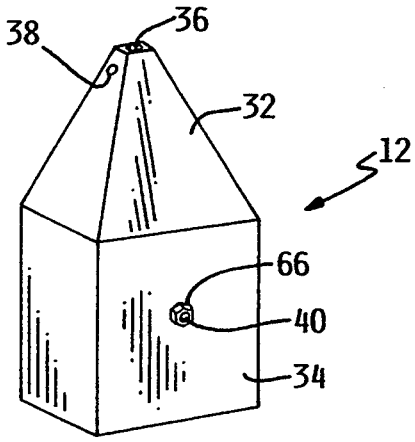
FIG. 3 is a isometric view of the bell member.
Figure 4:
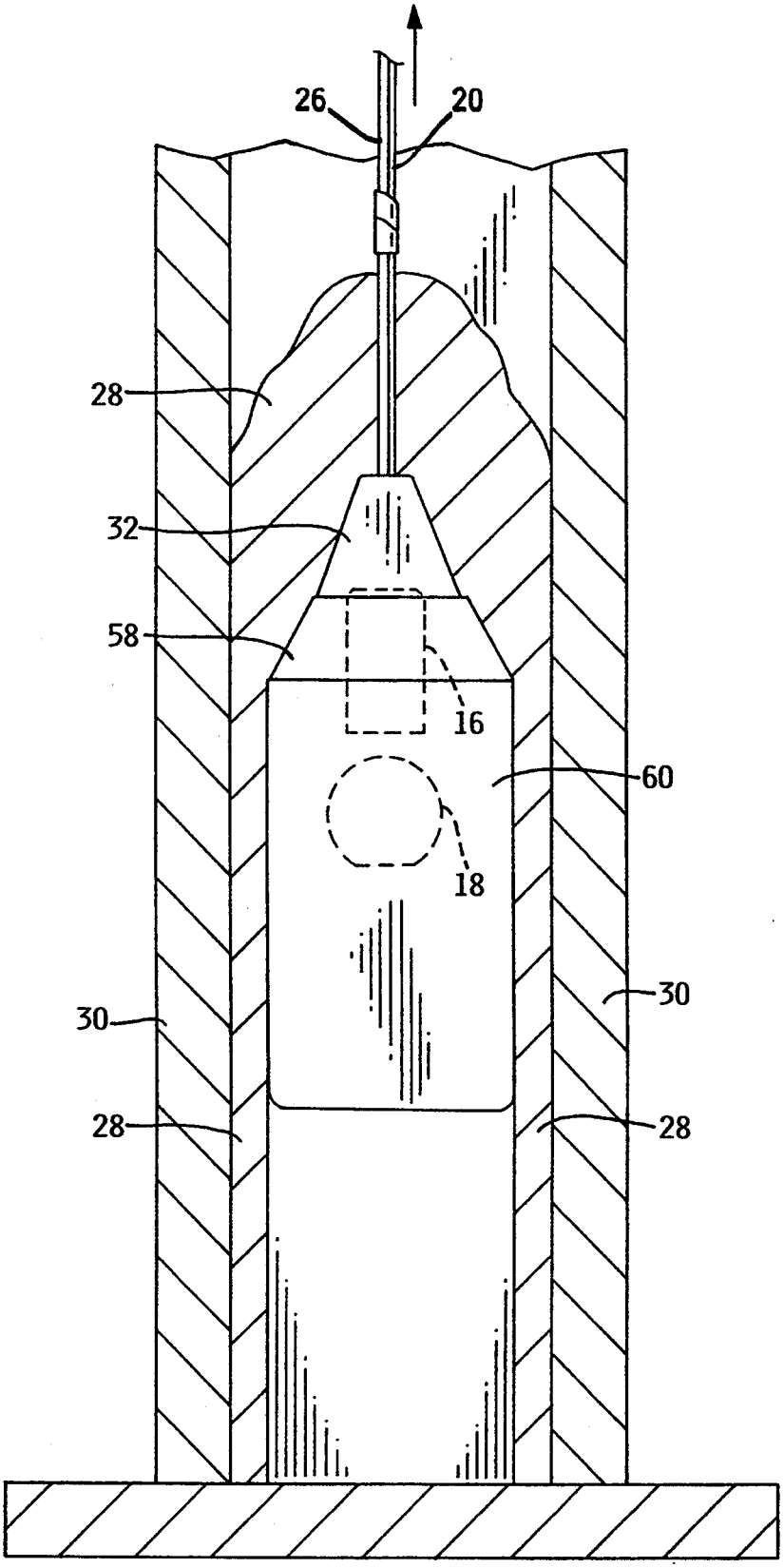
FIG. 4 is a partial phantom line, cross-sectional side view of the invention showing the operation of the invention during the lining of a chimney.

One form of the invention is illustrated and described herein. In general, the chimney lining former and compactor is indicated by the numeral 10. The chimney lining former and compactor 10 in general includes a bell member 12, vertical fastening means 14, a vibrator 16, a light 18, power cable 20, a shell member 22, a lateral fastening means 24, and a support cable 26. The chimney lining former and compactor 10 is preferably used for application of a heat resistant masonry mortar mix 28 to the interior surface of a chimney 30.

The bell member 12 is preferably formed of a metal material of sufficient strength and durability to not fracture, bend, break, split or fail during the compaction of the masonry mortar mix 28 to the interior surface of the chimney 30. The bell member 12 may be formed of any other material at the preference of an individual including, but not limited to, aluminum, steel, plastic, iron, stainless steel, or equivalents thereto, provided that the essential functions, features, and attributes described herein are not sacrificed.

The bell member 12 is preferably of standard size for use within a flue of a chimney 30. The standard size bell member 12 may be of any shape as preferred by an individual including, but not limited to, square, round, and/or rectangular. The standard diameter dimension for a round bell member 12 is either six inches or nine inches. The standard size dimension for a square bell member 12 is preferably either six square inches or nine square inches. A standard dimensional size for a rectangular bell member 12 is preferably six inches by ten inches. It should be noted that the dimensions provided herein may be significantly increased or decreased at the preference of an individual and have been illustrated herein to correspond to the most common size of chimney flues.

The bell member 12 includes a nose portion 32 and a box-shaped portion 34. The nose portion 32 tapers in size from the box-shaped portion 34. It should be noted that the box-shaped portion, as referenced herein, is descriptive of, and includes square, rectangular, and circular shapes. The box-shaped portion 34 corresponds to the portion of bell member 12 which is not tapered and contains the maximum size dimension.

In one embodiment, the nose portion 32 is preferably pyramid in shape. In an alternate embodiment, the nose portion 32 may be substantially conical in shape. In another alternative embodiment, the nose portion 32 is tapered in any shape as preferred by an individual. In the preferred embodiment, the nose portion 32 is pyramid in shape. In the preferred embodiment the box-shaped portion 34 is rectangular in shape; however, a circular or square shape may be selected for use within a circular or square chimney flue.

The bell member 12 preferably includes an open portion which is located opposite to the nose portion 32 and proximal to the lower edge of the box-shaped portion 34. The bell member 12 includes an interior and exterior surface.

A cable opening 36 preferably passes through the nose portion 32 permitting vertical access into the interior of the bell member 12. The cable opening 36 may be of any size as preferred by an individual and approximates one square inch. The cable opening 36 provides access into the interior of the bell member 12 for engagement of a support cable 26 to the vertical fastening means 14 for the raising or lowering of the chimney lining former and compactor 10 within the interior of the flue of a chimney 30. It should be noted that the cable opening 36 may be of any dimensional size as preferred by an individual provided that the essential functions, features, and attributes described herein are not sacrificed.

In the preferred embodiment, the nose portion 32 has a vertical dimension approximating eight inches in length, and the box-shaped portion 34 has a vertical length dimension approximating eight inches. The ratio of the vertical length of the box-shaped portion 34 to the vertical length of the nose portion 32 may suitably vary at the discretion of an individual and is preferably at least equal to, or greater than, one.

At least one headbolt aperture 38 passes through the exterior of the nose portion 32 proximal to the cable opening 36. The headbolt aperture 38 functions to provide a means for attachment of the vertical fastening means 14 to the bell member 12. The headbolt aperture 38 may be of any size as preferred by an individual provided that the structural strength and integrity of the nose portion 32 is not adversely affected. It should be noted that the structural integrity of the nose portion 32 is required in order to support the bell member 12, shell member 22, and masonry mortar mix 28 vertically within the flue during the lining of a chimney 30.

At least two fastener apertures 40 traverse the box-shaped portion 34 of the bell member 12. Each fastener aperture 40 is preferably centrally located through a face of the box-shaped portion 34 in order to maximize the structural strength and integrity of the bell member 12. In the preferred embodiment, a pair of fastener apertures 40 traverse through opposite faces of the box-shaped portion 34. It should be noted that the number of fastener apertures 40 may be increased to four at the preference of an individual. The fastener apertures 40 provide the mechanism for the lateral fastening means 24 to affix the shell member 22 to the exterior of the bell member 12.

The vertical fastening means 14 is preferably affixed to the interior of the bell member 12 proximate to the cable opening 36. The vertical fastening means 14 preferably includes a headbolt bracket 42 and a headbolt 44. It should be noted that any equivalent means may be used by an individual as an alternative to the headbolt bracket 42 and headbolt 44 without adversely affecting the attributes, features, and functions described herein. Examples of alternative vertical fastening means 14 may include, but are not limited to, nuts and bolts, rods, belts, shafts, hooks, ledges, screws, and welded plates. The primary objective of the vertical fastening means 14 is to provide a mechanism integrally attached to the interior of the bell member 12 which may be engaged by a support cable 26 for raising or lowering of the chimney lining former and compactor 10 within the flue of a chimney 30.

The headbolt bracket 42 is preferably formed of a sturdy metallic material with sufficient durability and gage thickness to not bend, fracture or fail when exposed to vibrational stress forces, while simultaneously supporting a bell member 12, shell member 22, and masonry mortar mix 28 within the interior of a flue of a chimney 30.

Any preferred means may be used to securely attach the headbolt bracket 42 to the interior of the bell member 12, proximal to the cable opening 36, including, but not limited to, nuts and bolts, screws, adhesives, and/or rivets. It should be noted that the headbolt bracket 42 is preferably formed of the same material as the bell member 12.

The headbolt bracket 42 is preferably welded to the interior of the bell member 12. The headbolt bracket 42 is also preferably aligned within the bell member 12 such that the headbolt 44 centrally traverses the cable opening 36 following its engagement to the headbolt bracket 42. The headbolt bracket 42 preferably includes threaded apertures for receiving engagement of a threaded headbolt 44. The headbolt 44 preferably is rotated for penetrating engagement into the threaded apertures of the headbolt bracket 42 completing the vertical fastening means 14.

The headbolt 44 is preferably formed of any sturdy metallic material. The headbolt 44 is preferably of sufficient strength and durability to not fracture, bend or fail when engaged to the headbolt bracket 42 and to the support cable 26. The headbolt 44 therefore has a sufficient diameter dimension in order to support the substantial weight of the bell member 12, shell member 22, and masonry mortar mix 28 during use of the chimney lining former and compactor 10.

A vibrator shelf 46 is preferably securely attached to the interior of the box-shaped portion 34 of the bell member 12, proximate to the nose portion 32. The vibrator shelf 46 is preferably formed of a sturdy metal material and is affixed to the box-shaped portion 34 by welding. The material selected for the vibrator shelf 46 may include, but is not limited to, aluminum, steel, stainless steel, and/or plastic provided that the essential functions, features, and attributes described herein are not sacrificed. The vibrator shelf 46 may be attached to the interior of the box-shaped member 34 by any alternative means as preferred by an individual including, but not limited to, the use of bolts and nuts, screws, rivets, and/or adhesives. It should be noted that the means selected for attachment of the vibrator shelf 46 to the interior of the box-shaped member 34 is preferably able to withstand vigorous and prolonged stress forces as caused by the vibrator 16 during the compaction of the masonry mortar mix 28 to the interior of the flue of a chimney 30.

The vibrator 16 is preferably affixed to, and rests upon, the vibrator shelf 46 within the interior of the bell member 12. The vibrator 16 is preferably electrically operated. In the preferred embodiment, the level of vibration may be suitably controlled upon the input of a desired level of electricity. Alternatively, the vibrator 16 may be powered by any equivalent means including, but not limited to, the use of a combustion engine and/or air pneumatic means at the preference of an individual. The vibrator 16 preferably functions to provide a desired level of movement of the bell member 12, and shell member 22, during compaction of the masonry mortar mix 28. The desired level of vibration may be adjusted by an individual depending upon the type and/or integrity of the interior surface of the flue, and the consistency or composition of the masonry mortar mix 28. An increased or decreased level of vibration may therefore be selected depending upon the environmental conditions encountered during the lining of a chimney 30.

The vibrator 16 may be affixed to the vibrator shelf 46 by any preferred means including, but not limited to, the use of nuts and bolts, screws, rivets, brackets, and/or welding at the preference of an individual. In the preferred embodiment, the vibrator 16 is welded to the vibrator shelf 46. The vibrator 16 is preferably formed of a twelve volt electrical motor having an offset rotational element having a standard 200 too 400 capacity as is known in the art.

A light 18 is preferably affixed to, and depends from, the vibrator shelf 46. The light 18 preferably emanates from the open bottom of the box-shaped portion 34 for illumination of the compacted masonry mortar mix 28, as applied to the interior surface of a flue of a chimney 30. The light 18 may be of any type as preferred by an individual provided that the light 18 does not break or fail upon exposure to vibrational stress forces as generated by the vibrator 16. In the preferred embodiment, the light 18 is adapted for use with a twelve volt electrical power source, which is compatible to the electrical power source of the vibrator 16. Engagement of the light 18 permits an individual to inspect the compacted masonry mortar mix 28 during use of the chimney lining former and compactor 10. The light 18 permits an individual to raise the chimney lining former and compactor 10 a few feet within a chimney 30 and inspect the compacted masonry mortar mix 28 from below. Adjustments to the vibrational level of the vibrator 16 may then be implemented based upon the inspection. The quality of the lining of a chimney 30 may therefore be significantly enhanced. In the preferred embodiment, the light 18 is enclosed within a shell which functions to focus the illumination in a downward direction through the open bottom of the box-shaped portion 34. The shell additionally protects the light 18 from breakage during use or transportation. It should be noted that the use of a light 18 may be eliminated at the preference of an individual.

A power cable 20 is preferably connected to both the vibrator 16 and the light 18. In the preferred embodiment, the power cable 20 is an electrical cord which includes suitable electrical insulation. Alternatively, the power cable 20 may be comprised of two different power supply means at the preference of an individual. In an alternative embodiment, the power cable 20 may include a pneumatic or air source for connection and operation of the vibrator 16, and an electrical cable for connection to and operation of the light 18. Preferably, the power cable 20 electrically connects the vibrator 16 and light 18 to a control 48. In the preferred embodiment, the power cable 20 is electrically affixed to, and extends upwardly from, the light 18 and the vibrator 16 through or past the vibrator shelf 46. The power cable 20 then extends upwardly through the cable opening 36 and the chimney 30 for engagement to a remotely positioned power source located on the roof of a building. In the preferred embodiment, the power cable 20 is also attached to the support cable 26, within the interior of the chimney 30, in order to avoid entanglement thereto during the raising or lowering of the chimney lining former and compactor 10.

A control 48 is preferably attached to the power cable 20 exterior to the chimney 30. The control 48 preferably includes a vibrator engagement switch 52, a vibrator control dial 54, and a light switch 56. The control 48 permits either the simultaneous or individual operation of the vibrator 16 and light 18 during use of the chimney lining former and compactor 10. The vibrator control dial 54 additionally permits an individual to adjust the level of vibration for compaction of the masonry mortar mix 28 depending upon the environmental conditions and/or the integrity of the interior surface of the chimney 30. The vibrator control dial 54 also permits an individual to adjust the level of vibration dependant upon the diameter dimension for the chimney 30 or the composition of the masonry mortar mix 28. The performance of the chimney lining former and compactor 10 is thereby significantly enhanced. During use of the chimney lining former and compactor 10, the control 48 is preferably located on a roof surface of a building, proximal to a winch (not shown) which contains the support cable 26 for either raising or lowering of a bell member 12 and shell member 22 within the interior of a chimney 30. It should also be noted that the supply of masonry mortar mix 28 is deposited into the chimney 30 proximal to the location of the winch and control 48. In an alternative embodiment, the control 48 may include a valve for operation of a pneumatic vibrator 16. It should be noted that the light switch 56 and vibrator engagement switch 54 may be of any preferred type including, but not limited to, plunger and/or lateral bar-type switches at the preference of an individual.

A fastener seat 50 is preferably located within the interior of the box-shaped portion 34 of the bell member 12 and is aligned to each of the fastener apertures 40. Each fastener seat 50 is preferably a nut for receiving engagement of the lateral fastening means 24. Each fastener seat 50 is preferably formed of sturdy metallic material of sufficient strength and durability to not fracture or fail upon exposure to the vibrational stress forces encountered during operation of the chimney lining former and compactor 10. Each fastener seat 50 may alternatively be formed of any material, including plastic, at the preference of an individual, so long as separation from the lateral fastening means 24 does not occur during use of the chimney lining former and compactor 10. Each fastener seat 50 may additionally be affixed to the interior of the box-shaped portion 34, of the bell member 12, by adhesives.

The shell member 22 is preferably formed of a metal material of sufficient strength and durability to not fracture, bend, break, split, or fail during the compaction of masonry mortar mix 28 to the interior surface of a chimney 30. The shell member 22 may be formed of any other material at the preference of an individual including, but not limited to, aluminum, steel, plastic, iron, stainless steel, or equivalents thereto, provided that the essential functions, features, and attributes described herein are not sacrificed. It should be noted that in the preferred embodiment the shell member 22 is formed of the same material as the bell member 12.

The shell member 22 is preferably of an enlarged size as compared to the bell member 12 during use within the flue of a chimney 30. The shell member 22 may be of any shape as preferred by an individual depending upon the shape selected for the bell member 12 including, but not limited to, square, round and/or rectangular. The diameter dimensions for a round shell member 22 are either seven or eight inches for use with a six-inch round bell member 12. The standard sized dimensions for a square shell member 22 are preferably either seven or eight square inches for use with a six-inch square bell member 12. A standard dimensional size for a rectangular shell member 22 is preferably seven by eleven inches, or eight by twelve inches, for use with a six-inch by ten-inch rectangular bell member 12. It should be noted that the dimensions provided herein may be significantly increased or decreased at the preference of an individual and have been illustrated herein to correspond to the most common size of chimney flues. It should also be noted that in larger sized chimneys, the shell member 22, having a ten or eleven-inch sized square or round diameter dimension, may be used with a standard square or round-shaped bell member 12 having a nine-inch diameter dimension. It should also be noted that the box-shaped bell engagement section 60 of the shell member 22 exceeds the size of the box-shaped portion 34 of the bell member 12 by the dimension of at least one-half inch on all sides. The increased size of the shell member 22 enables the use of a standard bell member 12 within a chimney 30 of larger diameter for compaction of masonry mortar mix 28.

The shell member 22 includes a nose engagement section 58 and a box-shaped bell engagement section 60. The nose engagement section 58 tapers in size from the box-shaped bell engagement section 60. It should be noted that the box-shaped bell engagement section 60, as referenced herein, includes square, rectangular, and circular shapes and corresponds to the portion of the shell member 22 which is not tapered and contains the maximum size dimension. The box-shaped bell engagement section 60 may therefore be either square, rectangular, or circular in shape at the preference of an individual.

In one embodiment, the nose engagement section 58 is preferably pyramid in shape. In an alternative embodiment, the nose engagement section 58 may be substantially conical in shape. In another alternative embodiment, the nose engagement section 58 may be tapered as preferred by an individual. In the preferred embodiment, the nose engagement section 58 is pyramid in shape. In the preferred embodiment, the box-shaped bell engagement section 60 is rectangular in shape; however, a shape of circular or square may be selected for use within a circular or square chimney flue.

The shell member 22 preferably includes an open portion which is located opposite to the nose engagement section 58 and proximal to the lower edge of the box-shaped bell engagement section 60. The shell member 22 includes an interior and an exterior surface.

A bell engagement opening 62 preferably passes through the nose engagement section 58 permitting the shell member 22 to telescopically embrace the exterior of the bell member 12. The bell engagement opening 62 may be of any size or shape as preferred by an individual, and is preferably rectangular having an approximate dimensional size of three inches by six inches. The bell engagement opening 62 provides the means for the telescopic interaction between the exterior of the bell member 12 and the interior of the shell member 22. The support cable 26 thereby raises or lowers both the bell member 12 and the shell member 22 within the interior of the flue of a chimney 30. It should be noted that the bell engagement opening 62 may be of any dimensional size as preferred by an individual provided that the essential functions, features, and attributes described herein are not sacrificed.

In the preferred embodiment, the nose engagement section 58 has a vertical dimension approximating one-half of the vertical dimension of the box-shaped bell engagement section 60. In this embodiment, the box-shaped bell engagement section 60 has a vertical length dimension approximating eight to twelve inches. The ratio of the vertical length of the box-shaped bell engagement section 60 to the vertical length of the nose engagement section 58 may suitably vary at the discretion of an individual. Preferably, the vertical length dimension for the box-shaped bell engagement 60 is at least one and one-half times as large as the vertical dimension for the nose engagement section 58.

It should be noted that the structural integrity of the nose engagement section 58 is required in order to support the shell member 22 and the masonry mortar mix 28 vertically upon the bell member 12 within the flue during the lining of a chimney 30.

At least two engagement apertures 64 traverse the box-shaped bell engagement section 60 of the shell member 22. Each engagement aperture 64 is preferably centrally located through a face of the box-shaped bell engagement section 60 in order to maximize the structural strength and integrity of the shell member 22. In the preferred embodiment, a pair of engagement apertures 64 traverse through opposite faces of the box-shaped bell engagement 60. It should be noted that the number of engagement apertures 64 may be increased to four at the preference of an individual. The engagement apertures 64 provide the mechanism for the lateral fastening means 24 to affix the shell member 22 to the exterior of the bell member 12. Each engagement aperture 64 is preferably aligned to a fastener aperture 40 and to a fastener seat 50.

The shell member 22, following telescopic embracement of a standard sized bell member 12, enables an individual to compact masonry mortar mix 28 to the interior of a chimney 30 of increased size. The shell member 22 is preferably formed of one piece and is securely attached to the bell member 12 by the lateral fastening means 24. The shell member 22 has an increased/improved structural strength, is more durable, and has a longer useful life than devices as known in the art. In the preferred embodiment, the vibrational forces of the bell member 12 are transferred equally to all of the exterior surfaces of the shell member 22 due to the fixed telescopic engagement of the shell member 22 to the bell member 12 via the lateral fastening means 24.

A spacer 66 is preferably engaged to the exterior of the bell member 12 and to the interior of the shell member 22 proximate to each engagement aperture 64 and each fastener aperture 40. Each spacer 66 is preferably cylindrical in shape having an appropriate dimensional width between one-half and one and one-half inches. A plurality of spacers 66 having a common width dimension are preferably used to uniformly separate the box-shaped bell engagement section 60 from the box-shaped portion 34 during use of the chimney lining former and compactor 10. The spacers 66 uniformly position the shell member 22 to the exterior of the bell member 12, such that uniform compaction of masonry mortar mix 28 occurs upon the raising of the chimney lining former and compactor 10 within a chimney 30. The spacers 66 are preferably of sufficient strength and durability to not fracture, break or fail upon prolonged and repeated exposure to vibrational forces as exerted by the bell member 12. The spacers 66 are preferably formed of resilient metallic, rubber or plastic material at the discretion of an individual. It should be noted that the spacers 66 may be cylindrical in shape and include apertures aligned to the fastener apertures 40 and the engagement apertures 64 at the preference of an individual.

The lateral fastening means 24 generally includes the elements of the fasteners 68, engagement apertures 64, spacers 66, fastener apertures 40, and fastener seats 50. In the preferred embodiment, the fasteners 68 are bolts which are adapted for penetrating engagement through the engagement apertures 64, spacers 66, fastener apertures 40, and into the fastener seats 50 for securing the shell member 22 to the exterior of the bell member 12. Alternatively, any equivalent of a bolt may be selected for a fastener 68 including, but not limited to, screws, clamps and/or latches at the preference of an individual. The purpose of the fastener 68 is to securely attach the shell member 22 to the bell member 12, and to provide a flush surface for compaction of masonry mortar mix 28 during lining of a chimney 30. Another purpose of a fastener 68 is to provide a fast, convenient, and efficient means for releasing the engagement of the shell member 22, from the bell member 12, so that a shell member 22 of alternate size may be quickly placed over the exterior of a standard sized bell member 12. The lateral fastening means 24 and the fasteners 68 are therefore required to be conveniently located for manipulation by an individual during the replacement of a shell member 22.

The lateral fastening means 24 rigidly affixes the shell member 22 to the bell member 12 providing the structural integrity of a one-piece device. The vibration of the bell member 12 is then efficiently passed to the exterior of the shell member 22 for compaction of masonry mortar mix 28. Alternative lateral fastening means 24 may be selected by an individual for telescopically embracing the shell member 22 to the bell member 12. Alternative lateral fastening means 24 may include, but are not limited to, clamps, latches, intercoupling brackets or shelves, and/or equivalents thereto at the preference of an individual. Preferably, the lateral fastening means 24 provides a flush exterior surface for compacting a smooth layer of masonry mortar mix 28. It should be noted that the fastener apertures 40 preferably flushly receive a fastener 68 providing a smooth exterior surface for the bell member 12, when the use of a shell member 22 is not required for the lining of a standard sized chimney 30.

A support cable 26 is preferably releasably engaged to the vertical fastening means 14 for raising or lowering of the shell member 22, as telescopically embraced to the bell member 12, within the interior of a chimney 30. The support cable 26 preferably includes a hook means for attachment to the headbolt 44 within the interior of the bell member 12. The support cable 26 preferably passes through the cable opening 36 and is attached to the power cable 20 during use of the chimney lining former and compactor 10. The support cable 26 may be formed of rope, metal, steel, chains, and equivalents thereof, as preferred by an individual. Support cable 26 is required to be of sufficient strength to support the bell member 12, shell member 22, and masonry mortar mix 28 during the lining of a chimney 30.

The support cable 26 is preferably coiled upon a winch located on the roof of a building over a chimney 30. The winch preferably lowers the chimney lining former and compactor 10 to the bottom of the chimney 30, via the support cable 26, prior to the initiation of lining procedures. Mixed masonry mortar 28 is then deposited down the chimney 30 for engagement to the top of the bell member 12 and the shell member 22. The vibrator 16 of the chimney lining former and compactor 10 is then activated by manipulation of the vibrator engagement switch 52 of the control 48. The vibration of the bell member 12 and shell member 22 causes the masonry mortar mix 28 to flow off the top of the bell member 12 and shell member 22 to a position between the interior surface of a chimney 30 and the box-shaped bell engagement section 60, for compaction to the interior walls of the chimney 30. The winch then raises the chimney lining former and compactor 10 upwardly within the chimney 30 during the lining of the flue. The light 18 may also be activated, providing an individual with the ability to inspect the chimney lining prior to the completion of the project. Masonry mortar mix 28 is preferably deposited down a chimney 30, as needed, in order to facilitate the even compaction of material within the chimney flue. The winch may then raise the chimney lining former and compactor 10 at a desired rate for the lining of a chimney 30. Upon completion of the project, the bell member 12 and the shell member 22 may be easily separated and/or cleaned, eliminating time consuming separation and cleaning procedures. In addition, the one-piece shell member 22, as telescopically embraced to the one-piece bell member 12, maximizes the structural integrity and durability of the chimney lining former and compactor 10 permitting the use of increased vibrational stress forces during the lining of a chimney 30. A standard bell member 12 may also be used with a plurality of shell members 22 for lining of chimneys 30 of varying size.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A device for lining a chimney with masonry mortar comprising:

(a) a bell member having a nose portion, and a box-shaped lower portion, said nose portion having a cable opening, said bell member further having a vertical fastening means proximate to said nose portion and said cable opening, and a supporting cable secured to said vertical fastening means for raising or lowering of said bell member, said bell member further comprising a vibrator attached to said box-shaped lower portion within said bell member proximate to said nose portion, said bell member further having a power cable affixed to said vibrator passing through said cable opening for operation of said vibrator; and (b) a shell member having a nose engagement section having a bell engagement opening, said nose engagement section telescopically embracing said nose portion of said bell member and supporting said shell member on said bell member, said shell member further comprising a box-shaped bell engagement section having lateral fastening means for attaching said shell member to said bell member such that said supporting cable raises or lowers both of said bell member and said shell member simultaneously during the compaction of mortar and lining of a chimney.

2. A device for lining of a chimney with masonry mortar comprising:

(a) a bell member having a nose portion, and a box-shaped lower portion, said nose portion having a cable opening, said box-shaped lower portion having a lateral fastening means, said bell member further comprising a vertical fastening means proximate to said cable opening and to said nose portion, said bell member further comprising a vibrator attached to said box-shaped lower portion within said bell member proximate to said nose portion, said bell member further comprising a light affixed to and depending from said box-shaped lower portion proximate to said vibrator, said bell member further comprising a power cable affixed to said light and to said vibrator passing through said cable opening, said power cable being connected to a control switch for the simultaneous or individual operation of said vibrator or said light, said bell member further comprising a support cable secured to said vertical fastening means for raising or lowering of said bell member; and (b) a shell member having a nose engagement section having a bell engagement opening, said nose engagement section telescopically embracing said nose portion of bell member supporting said shell member on said bell member, said shell member further comprising a box-shaped bell engagement section having at least two fasteners and at least two spacing means for spacing the shell member from the bell member aligned to said lateral fastening means, said fasteners engaging said lateral fasting means for attaching said shell member to said bell member such that said support cable raises or lowers both of said bell member and said shell member simultaneously during the compaction of the mortar and lining of a chimney.

3. A device for lining a chimney with masonry mortar comprising:

(a) a bell member having an exterior, an interior, a nose portion, and a box-shaped lower portion, said nose portion having a cable opening, said box-shaped lower portion having at least two fastener apertures having aligned fastener seats attached thereto, said bell member further having a headbolt bracket attached to said interior of said bell member proximate to said cable opening and said nose portion, said bell member further comprising a vibrator shelf attached to said box-shaped lower portion within said bell member proximate to said nose portion, and a vibrator affixed to said vibrator shelf, said bell member further having a light affixed to and depending from said vibrator shelf, said box-shaped lower portion comprising an open lower section permitting light to emanate from said interior, said bell member further comprising a power cable affixed to said light and to said vibrator passing through said cable opening, said power cable having a control comprising a vibrator switch, a vibrator control dial, and a light switch for the simultaneous or individual operation of said vibrator or said light, said bell member further comprising a headbolt engaged to said headbolt bracket and a support cable secured to said headbolt for raising or lowering of said bell member; and (b) a shell member having a nose engagement section having a bell engagement opening, said nose engagement section telescopically embracing said exterior of nose portion of said bell member and supporting said shell member on said bell member, said shell member further comprising a box-shaped bell engagement section having at least two engagement apertures therethrough aligned to said fastener apertures, said box-shaped bell engagement section comprising an open lower edge, said shell member further comprising at least two spacers aligned to said fastener apertures and to said engagement apertures between said box-shaped lower portion and said box-shaped bell engagement section, said shell member further comprising a fastener engaged to each of said fastener seats, said fasteners passing through said fastener apertures and through said engagement apertures attaching said shell member to said bell member such that said support cable raises or lowers both of said bell member and said shell member simultaneously during compaction of mortar and lining of a chimney.

4. The chimney lining device according to claim 1, wherein said nose portion is pyramidal in shape.

5. The chimney lining device according to claim 4, wherein said vertical fastening means comprises a headbolt bracket attached to said interior of said bell member proximate to said cable opening and said nose portion.

6. The chimney lining device according to claim 5, wherein said box-shaped lower portion further comprises at least two fastener apertures having aligned fastener seats attached thereto.

7. The chimney lining device according to claim 6, wherein said bell member further comprises a vibrator shelf attached to said box-shaped lower portion within said bell member proximate to said nose portion.

8. The chimney lining device according to claim 7, wherein said vibrator is affixed to and rests upon said vibrator shelf.

9. The chimney lining device according to claim 8, wherein said bell member further comprises a light affixed to and depending from said vibrator shelf.

10. The chimney lining device according to claim 9, wherein said power cable is affixed to said light and to said vibrator.

11. The chimney lining device according to claim 10, wherein said power cable is connected to a control comprising a vibrator switch, a vibrator control dial, and a light switch providing for the simultaneous or individual operation of said vibrator or said light.

12. The chimney lining device according to claim 11, wherein said bell member further comprises a headbolt engaged to said headbolt bracket and to said support cable for raising or lowering of said bell member within said chimney.

13. The chimney lining device according to claim 12, wherein said lateral fastening means further comprises at least two engagement apertures through said box-shaped bell engagement section aligned to said fastener apertures.

14. The chimney lining device according to claim 13, wherein said shell member further comprises at least two spacers aligned to said fastener apertures and to said engagement apertures between said box-shaped lower portion and said box-shaped bell engagement section for separation of said box-shaped lower portion from said box-shaped bell engagement section.

15. The chimney lining device according to claim 14, wherein said lateral fastening means further comprises a fastener engaged to each of said fastener seats where said fasteners pass through said fastener apertures and through said engagement apertures attaching said shell member to said bell member.

* * * * *